US010277977B1

(12) United States Patent
Seki

(10) Patent No.: US 10,277,977 B1
(45) Date of Patent: Apr. 30, 2019

(54) SOUND REPRODUCTION SYSTEM, MOBILE OBJECT, AND SOUND REPRODUCTION METHOD

(71) Applicant: PANASONIC INTELLECTUAL PROPERTY MANAGEMENT CO., LTD., Osaka (JP)

(72) Inventor: Takayuki Seki, Kanagawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/170,701

(22) Filed: Oct. 25, 2018

(30) Foreign Application Priority Data

Oct. 30, 2017 (JP) ..... 2017-209662

(51) Int. Cl.

| | |
|---|---|
| ***H04R 1/02*** | (2006.01) |
| ***H04R 1/28*** | (2006.01) |
| ***H04R 1/00*** | (2006.01) |
| ***H04R 5/04*** | (2006.01) |

(52) U.S. Cl.
CPC ..... *H04R 1/2803* (2013.01); *H04R 1/005* (2013.01); *H04R 5/04* (2013.01)

(58) Field of Classification Search
CPC ..... H04R 1/02
See application file for complete search history.

(56) References Cited

U.S. PATENT DOCUMENTS

| | | | | |
|---|---|---|---|---|
| 2014/0056431 | A1 | 2/2014 | Kano | |
| 2015/0189438 | A1* | 7/2015 | Hampiholi | G06F 3/165 381/80 |
| 2015/0256933 | A1* | 9/2015 | Vautin | H04R 3/12 381/86 |
| 2017/0048606 | A1* | 2/2017 | Fan | H04R 1/1041 |
| 2017/0085990 | A1* | 3/2017 | Sladeczek | H04S 3/00 |
| 2017/0193976 | A1* | 7/2017 | Mohammad | G10K 11/178 |
| 2018/0190282 | A1* | 7/2018 | Mohammad | G10K 11/178 |

FOREIGN PATENT DOCUMENTS

| | | |
|---|---|---|
| WO | 2013/099093 | 7/2013 |

* cited by examiner

*Primary Examiner* — Olisa Anwah
(74) *Attorney, Agent, or Firm* — Greenblum & Bernstein, P.L.C.

(57) ABSTRACT

Disclosed herein is a sound reproduction system configured to emit a first sound and a second sound from a loudspeaker at a time. The first sound is intended to reach ears of an object person's. The second sound is intended to reach ears of a non-object person's and compliant with a control characteristic. The control characteristic is defined such that the second sound includes a component which is emitted from the loudspeaker toward a first region occupied by the object person and has a sound pressure lower than a predetermined value, and another component which is emitted from the loudspeaker toward a second region occupied by the non-object person and has a sound pressure equal to the predetermined value.

20 Claims, 13 Drawing Sheets

SOUND REPRODUCTION SYSTEM, MOBILE OBJECT, AND SOUND REPRODUCTION METHOD

CROSS-REFERENCE TO RELATED APPLICATION

This application claims the benefit of foreign priority to Japanese Patent Application No. 2017-209662 filed on Oct. 30, 2017, which is assigned to the assignee of the present application.

TECHNICAL FIELD

The present disclosure generally relates to a sound reproduction system, a mobile object, and a sound reproduction method, and more particularly relates to a sound reproduction system, mobile object, and sound reproduction method for reproducing a sound from a sound source.

BACKGROUND ART

WO 2013/099093 A1 (hereinafter referred to as D1) discloses a sound field control device configured to reproduce a desired sound in a listening area and mitigate that sound in an area surrounding the listening area. The sound field control device disclosed in D1 includes a control filter and a listening correction filter.

The listening correction filter performs signal processing on an input signal from a sound source in accordance with a preset control characteristic, thus generating a second output signal and outputting the signal to a second speaker. The control filter performs signal processing on the second output signal supplied from the listening correction filter in accordance with the preset control characteristic, thus generating a first output signal and outputting the signal to a first speaker.

The control filter has a control characteristic in which, by means of a sound played back from the first speaker, a sound played back from the second speaker is reduced in an area surrounding the listening area. The listening correction filter has a control characteristic in which, by means of the sounds played back from the first and second speakers, a sound having a specified target acoustic characteristic emerges in the listening area.

The sound field control device (sound reproduction system) disclosed in D1, however, could make the desired sound (corresponding to the "first sound") audible to not only a person in the listening area (corresponding to the "first region") but also a person in an area surrounding the listening area (corresponding to the "second region") as well.

SUMMARY OF INVENTION

The present disclosure provides a sound reproduction system, mobile object, and sound reproduction method, all of which are able to make a component of the first sound clearly audible in the first region and another component of the first sound less clearly audible in the second region.

A sound reproduction system according to an aspect of the present disclosure is configured to emit a first sound and a second sound from a loudspeaker at a time. The first sound is intended to reach the ears of an object person's. The second sound is intended to reach the ears of a non-object person's and compliant with a control characteristic. The control characteristic is defined such that the second sound includes a component which is emitted from the loudspeaker toward a first region occupied by the object person and has a sound pressure lower than a predetermined value, and another component which is emitted from the loudspeaker toward a second region occupied by the non-object person and has a sound pressure equal to the predetermined value.

A mobile object according to another aspect of the present disclosure includes: the sound reproduction system described above; and a mobile object body equipped with the loudspeaker.

A sound reproduction method according to still another aspect of the present disclosure is designed to emit a first sound and a second sound from a loudspeaker at a time. The first sound is intended to reach the ears of an object person's. The second sound is intended to reach the ears of a non-object person's and compliant with a control characteristic. The control characteristic is defined such that the second sound includes a component which is emitted from the loudspeaker toward a first region occupied by the object person and has a sound pressure lower than a predetermined value, and another component which is emitted from the loudspeaker toward a second region occupied by the non-object person and has a sound pressure equal to the predetermined value.

DESCRIPTION OF EMBODIMENTS

First Embodiment (1) Overview

Figure 1:
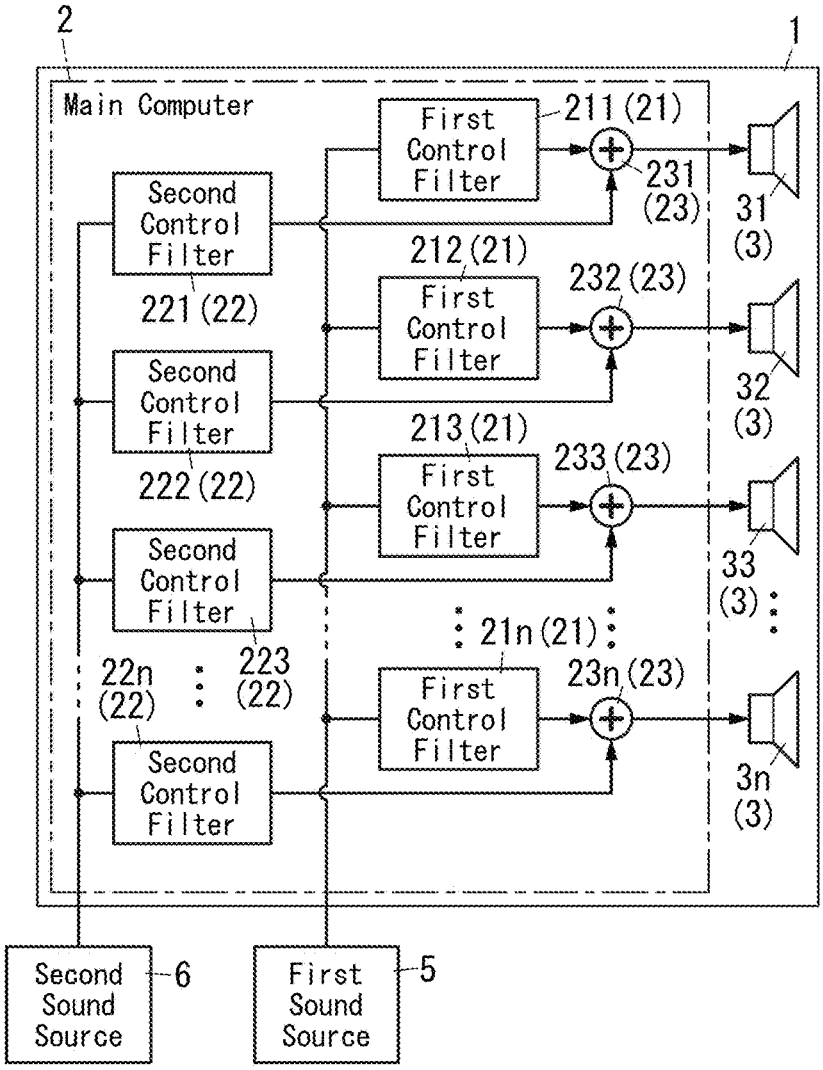
FIG. 1 is a block diagram of a sound reproduction system according to a first embodiment.

An overview of a sound reproduction system 1 and mobile object 10 according to an exemplary embodiment will be described with reference to FIGS. 1 and 2.

A sound reproduction system 1 according to this exemplary embodiment may be provided for a mobile object 10, for example, and is configured to make a component of a first sound clearly audible to an object person P1 present in the mobile object 10 and another component of the first sound less clearly audible to non-object persons P2-P4 present in the same mobile object 10. According to this embodiment, the mobile object 10 is supposed to be a passenger car, for example. Therefore, in this specific example, the object person P1 may be a driver seated in the driver's seat of the passenger car, and the non-object persons P2-P4 may be persons seated in the assistant driver's seat and passenger seats of the same passenger car (see FIG. 2). As used herein, the "first sound" refers to a sound intended to reach the ears of the object person's P1. Examples of the first sound include the voice guidance emitted from an onboard car navigation system installed in the passenger car and the voice of the person calling the driver using a hands-free system installed in the passenger car. There is no problem even if the voice guidance emitted as the first sound is audible to the other persons in the same car. However, in some cases, the driver does not want the phone call voice to be audible to the other persons in the same car.

To overcome such a problem, the sound field control device disclosed in D1 cited above makes the sound played back from a second speaker less clearly audible around the listening area with the sound played back from a first speaker. Still, according to this configuration, there are chances of the desired sound (first sound) being audible clearly enough even around the listening area. That is to say, the sound field control device disclosed in D1 could allow not only the person present in the listening area but also other persons present around the listening area to listen to the phone call voice through a hands-free system.

Thus, the sound reproduction system 1 according to this exemplary embodiment has the following configuration to make a component of the first sound clearly audible to the object person P1 and another component of the first sound less clearly audible to the non-object persons P2-P4.

The sound reproduction system 1 according to this exemplary embodiment is configured to emit a first sound and a second sound at a time from a loudspeaker 3. The first sound is intended to reach ears of an object person's P1. The second sound is intended to reach ears of a non-object person's P2-P4 and compliant with a control characteristic (second control characteristic). The control characteristic is defined such that the second sound includes a component which is emitted from the loudspeaker 3 toward a first region Re1 and has a sound pressure lower than a predetermined value, and another component which is emitted from the loudspeaker 3 toward a second region Re2-Re4 and has a sound pressure equal to the predetermined value. The first region Re1 is a region occupied by the object person P1. The second region Re2-Re4 is a region occupied by any of the non-object persons P2-P4. As used herein, the "second sound" is intended to reach the ears of the non-object persons' P2-P4, and may be pink noise, road noise, or any other types of sound in this embodiment. However, this is only an example and should not be construed as limiting. Alternatively, the second sound does not have to be any of these noises but may also be, for example, music to reach the ears of the non-object persons' P2-P4. In this case, the second sound may be emitted either intermittently only while the first sound is being emitted or continuously. Emitting the second sound continuously is less likely to make the non-object persons P2-P4 find the second sound unnatural, which is beneficial.

Also, the mobile object 10 according to this exemplary embodiment includes the sound reproduction system 1 described above and a mobile object body 100 equipped with the loudspeaker 3. In this exemplary embodiment, the mobile object 10 may be a passenger car and the mobile object body 100 may be a car body, for example. Also, in the sound reproduction system 1 according to this embodiment, an object space SP10 includes a first space SP1 and second spaces SP2-SP4 as shown in FIG. 2. The first space SP1 is provided to accommodate the object person P1 and includes the first region Re1. The second spaces SP2-SP4 are provided to accommodate the non-object persons P2-P4 and include the second regions Re2-Re4. According to this embodiment, the object space SP10 is the vehicle cabin of a passenger car. Also, according to this embodiment, the first space SP1 is a space including a driver's seat, the second space SP2 is a space including an assistant driver's seat, and the second spaces SP3 and SP4 are spaces including a rear seat. In the embodiment to be described below, the number of the first space SP1 is supposed to be one. However, this is only an example and should not be construed as limiting. Alternatively, there may be a plurality of first spaces SP1. In other words, the sound reproduction system 1 may also be configured to make the first sound audible to a plurality of object persons P1.

In the sound reproduction system 1 according to this embodiment, a component, emitted from the loudspeaker 3 toward the first region Re1, of the second sound has a sound pressure lower than a predetermined value, and another component, emitted from the loudspeaker 3 toward the second regions Re2-Re4, of the second sound has a sound pressure equal to the predetermined value, as described above. That is why even if a component of the first sound emitted from the loudspeaker 3 toward the first region Re1 has the same sound pressure as another component of the first sound emitted from the loudspeaker 3 toward the second region Re2-Re4, this configuration is still able to make the former component of the first sound clearly audible in the first region Re1 and the latter component of the first sound less clearly audible in the second region Re2-Re4.

(2) Details

Next, a sound reproduction system 1 and mobile object 10 according to this embodiment will be described in further detail with reference to FIGS. 1 and 2.

(2.1) Sound Reproduction System

As shown in FIG. 1, a sound reproduction system 1 according to this embodiment includes a main computer 2 and at least one loudspeaker 31-3*n* (where n=1, 2, and so on). Note that the at least one loudspeaker 31-3*n* is not an essential element for the sound reproduction system 1 but may also be installed in advance in the mobile object 10, for example. In other words, the loudspeaker 31-3*n* does not have to form part of the sound reproduction system 1. In the following description, when a plurality of loudspeakers 31-3*n* are provided, the plurality of loudspeakers 31-3*n* will be hereinafter collectively referred to as "loudspeakers 3" if there is no need to distinguish them from each other.

The main computer 2 includes at least one first control filter 211-21*n* (where n=1, 2, and so on), at least one second control filter 221-22*n* (where n=1, 2, and so on), and at least one adder 231-23*n* (where n=1, 2, and so on). In this embodiment, the main computer 2 is a computer system including, as primary hardware components, a processor and a memory. In this main computer 2, the functions of the at least one first control filter 211-21*n*, the at least one second control filter 221-22*n*, and the at least one adder 231-23*n* may be performed by the processor executing a program stored in the memory. The program may be stored in advance in the memory of the main computer 2, downloaded via a telecommunications line such as the Internet, or distributed after having been stored in a non-transitory computer-readable storage medium such as an optical disc or a hard disk drive.

The main computer 2 is connected to not only the at least one loudspeaker 3 but also a first sound source 5 and a second sound source 6 as well. The first sound source 5 is a sound source for emitting the first sound (target sound) that should be audible to the object person P1. Examples of the first sound source 5 include various types of storage media and recording media such as compact discs (CDs), vinyl records, and hard disks, and telecommunications devices such as cellphones and smartphones. The first sound emitted from the first sound source 5 may be voice, music, or alarm sounds, for example, and is a sound to be made audible only at a particular spatial position. The second sound source 6 is a sound source for emitting the second sound (such as a masker) to make a component of the first sound less clearly audible to the non-object persons P2-P4. Just like the first sound source 5, the second sound source 6 may also be any of various types of storage media and recording media such as compact discs (CDs), vinyl records, and hard disks. The second sound emitted from the second sound source 6 is an environmental sound such as a pink noise or a road noise, and is a masker that makes the component of the first sound less clearly audible at every position other than the particular spatial position. Note that the first sound source 5 and the second sound source 6 do not have to be such storage media but may also be a server provided outside of the sound reproduction system 1, for example. In that case, the sound reproduction system 1 may be configured to acquire the first and second sounds from the server via a telecommunications line such as the Internet, for example.

In the following description, when a plurality of first control filters 211-21*n* are provided, the plurality of first control filters 211-21*n* will be hereinafter collectively referred to as "first control filters 21" if there is no need to distinguish them from each other. Likewise, in the following description, when a plurality of second control filters 221-22*n* are provided, the plurality of second control filters 221-22*n* will be hereinafter collectively referred to as "second control filters 22" if there is no need to distinguish them from each other. Furthermore, in the following description, when a plurality of adders 231-23*n* are provided, the plurality of adders 231-23*n* will be hereinafter collectively referred to as "adders 23" if there is no need to distinguish them from each other.

The first control filters 21 are each configured to perform signal processing on the first sound emitted from the first sound source 5 based on the propagation characteristic of the sound from an associated one of the loudspeakers 3 to the respective spaces SP1-SP4. The first control filters 21 perform signal processing on the first sound in accordance with a first control characteristic. The first control characteristic is defined such that the first sound includes components, one of which is emitted from the loudspeaker 3 toward the first region Re1 and the other of which is emitted from the loudspeaker 3 toward the second regions Re2-Re4 and has a lower sound pressure than the former component. In this embodiment, the first region Re1 is a region where the head of the object person P1 is located, while each of the second regions Re2-Re4 is a region where the head of an associated one of the non-object persons P2-P4 is located (see FIG. 2). The first sound subjected to the signal processing by the first control filters 21 includes a component which is louder, and therefore, clearly audible, in the first region Re1, and another component which is fainter, and therefore, less clearly audible, in the second regions Re2-Re4. The first control filters 21 will be described in further detail later in "(2.3) First control filters."

The second control filters 22 are each configured to perform signal processing on the second sound emitted from the second sound source 6 based on the propagation characteristic of the sound from an associated one of the loudspeakers 3 to the respective spaces SP1-SP4. The second control filters 22 perform signal processing on the second sound in accordance with a second control characteristic. The second control characteristic is defined such that a component, emitted from each of the loudspeakers 3 toward the first region Re1, of the second sound has a sound pressure lower than a predetermined value and that another component, emitted from the loudspeaker 3 toward the second regions Re2-Re4, of the second sound has a sound pressure equal to the predetermined value. The second sound subjected to the signal processing by the second control filters 22 includes a component which has become fainter in the first region Re1 and another component which has become louder in the second regions Re2-Re4. In other words, in the first region Re1, a Null point is formed with respect to the second sound. The second control filters 22 will be described in further detail later in "(2.4) Second control filters."

Each of the adders 23 adds together the first sound emitted from the first sound source 5 and subjected to the signal processing by an associated one of the first control filters 21 and the second sound emitted from the second sound source 6 and subjected to the signal processing by an associated one of the second control filters 22, and outputs an audio signal representing the sum to an associated one of the loudspeakers 3.

Each of the loudspeakers 3 emits (or reproduces) the first sound and the second sound in accordance with the audio signal from an associated one of the adders 23.

Note that the sound propagation characteristic may be either measured in advance or presumed by the main computer 2.

(2.2) Mobile Object

Figure 2:
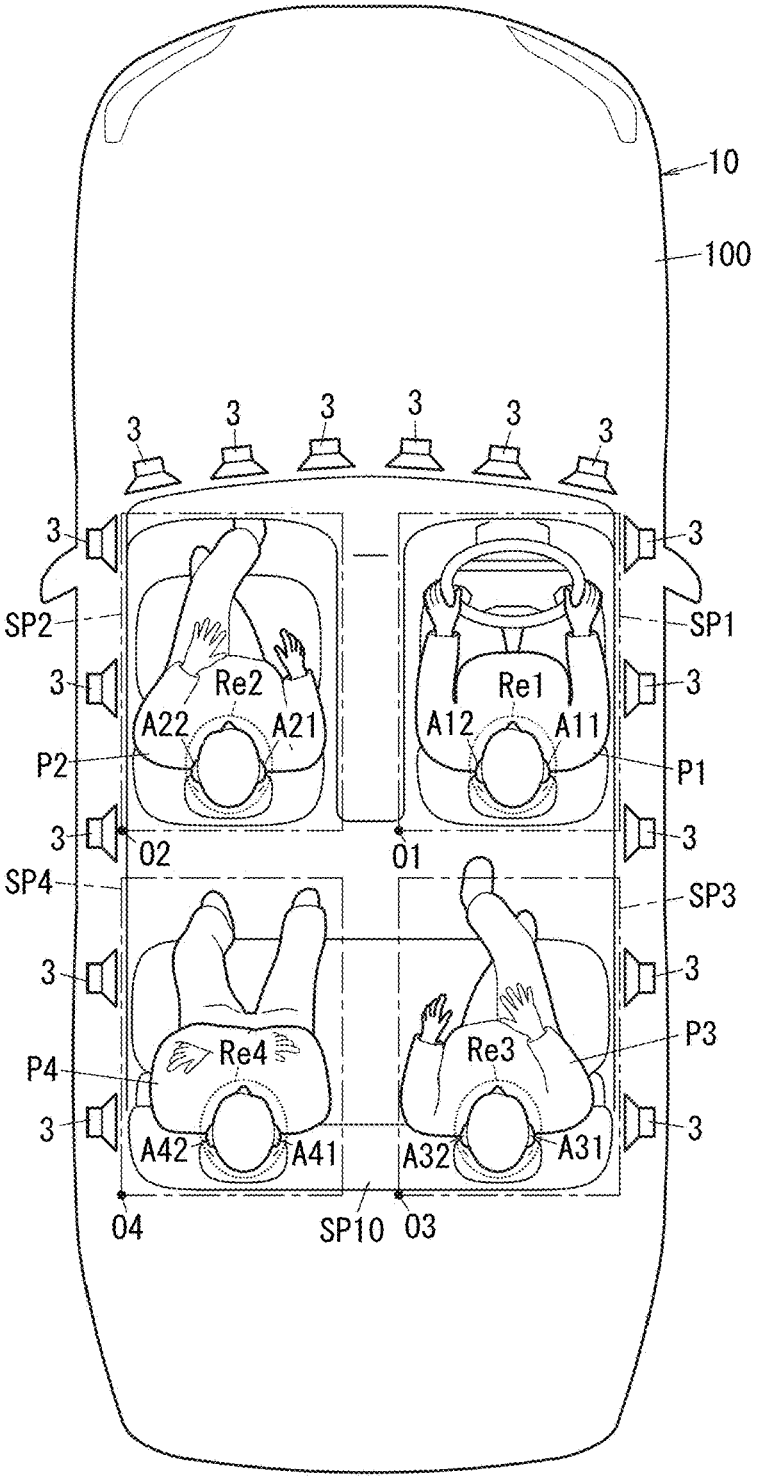
FIG. 2 is a schematic representation of a mobile object to which the sound reproduction system is applied.

A mobile object 10 according to this embodiment may be, for example, a passenger car with a mobile object body (car body) 100 as shown in FIG. 2. The mobile object 10 has an object space SP10. The object space SP10 includes a first space SP1 and a plurality of second spaces SP2-SP4. The first space SP1 is provided to accommodate the object person P1, and may cover the driver's seat in this embodiment. The second space SP2 is provided to accommodate the non-object person P2, and may cover the assistant driver's seat in this embodiment. The second spaces SP3 and SP4 are provided to accommodate the non-object persons P3 and P4, and may cover the rear seat in this embodiment. The mobile object 10 is equipped with a plurality of (e.g., sixteen in the example illustrated in FIG. 2) loudspeakers 3. Those loudspeakers 3 are arranged in front, and on the right and left, of the object space SP10 (see FIG. 2). Note that the number of loudspeakers 3 provided is only an example and needs to be at least equal to one.

(2.3) First Control Filters

The plurality of first control filters 211-21*n* are each configured to increase the sound pressure of a component of the first sound at a desired position (e.g., the first region Re1 in this embodiment) and decrease the sound pressure of another component of the first sound at every position other than the desired position (e.g., the second regions Re2-Re4 in this embodiment) as described above. Examples of the methods employed by the plurality of first control filters 21 to calculate filter coefficients include the truncated singular value decomposition, the least squares method, and the weighted least squares method. As used herein, the truncated singular value decomposition is a technique for calculating an inverse filter at a point of measurement using a matrix obtained by performing singular value decomposition on a propagation characteristic matrix. The truncated singular value decomposition or the least squares method is a technique for focusing the sound pressure at a desired position by realizing inverse filtering, which cancels the reverberation, at the desired position. Therefore, in a space that causes deep reverberation, it is difficult to perform inverse filtering, and the difference in sound pressure between a suppressed position where the reproduced sound is suppressed and the desired position tends to be less significant compared to a space that causes shallow reverberation. That is why the weighted least squares method is suitably employed as a method for calculating the filter coefficients for the plurality of first control filters 211-21*n*. In other words, the first control characteristic is suitably determined by the weighted least squares method. The weighted least squares method allows a significant difference in sound pressure to be created, even in a space that causes deep reverberation, between the desired position and the suppressed position by broadening the width of a tolerance range for the inverse filtering at the desired position and by narrowing the width of a tolerance range for the suppression characteristic at the suppressed position. The weighted least squares method is represented by the following Equation (1):

$$H(\omega)=(G(\omega)^H WG(\omega)+\lambda I)^{-1}G(\omega)^H Wd \tag{1}$$

where H(ω) is a filter coefficient vector, G(ω) is an H complex conjugate transpose of a transfer function matrix between the loudspeaker 3 and a control position (which may be either the desired position or the suppressed position), W is a weight matrix, which is a diagonal matrix for determining the weight for the control position, λ is a regularization parameter, I is a unitary matrix, and d is a desired characteristic vector at a control point. For example, setting, by adjusting this desired characteristic vector d for a desired position, a propagation characteristic between the loudspeaker 3 and the desired position and setting the desired characteristic vector d at zero for the suppressed position allows the sound pressure to be increased at the desired position and decreased at the suppressed position.

Also, the weight value is adaptively changeable according to the (absolute) magnitude of the Null space generated by the second control filters 22. Furthermore, the magnitude of the sound pressure of the first sound focused at the desired position by the first control filters 21 is also changeable by weighting. For example, the weight value may be changed so that the greater the Null space is, the greater the magnitude of the sound pressure of the first sound focused at the desired position is. As can be seen, this combination of the weighted least squares method and the Null-space based sound field control (NBSFC) allows the magnitude of the sound pressure of the first sound focused at the desired position to be set based on the magnitude of the Null space.

To design the first control filters 21, the weight matrix W, the regularization parameter 2, and the desired characteristic vector d are suitably set based on the propagation characteristic measured in advance by a microphone, for example.

(2.4) Second Control Filters

The plurality of second control filters 221-22*n* are configured to create the Null space at the desired position (e.g., in the first region Re1 in this embodiment). Examples of methods for calculating filter coefficients for the plurality of second control filters 221-22*n* include phase control and NBSFC. The phase control, however, does not allow the Null space to be created in a space with reflection, and therefore, imposes some constraints on the arrangement of the loudspeakers 3 and the location of the first region Re1, for example. That is why NBSFC is suitably adopted as a method for calculating filter coefficients for the plurality of second control filters 221-22*n*. In other words, the second control characteristic is suitably determined by NBSFC, which is represented by the following Equation (2):

$$H'(\omega) = C\frac{W(\omega)W(\omega)^H l(\omega)}{\sqrt{l(\omega)^H W(\omega)W(\omega)^H l(\omega)}} \tag{2}$$

where H'(ω) is a filter coefficient vector for the second sound (masker), C is a gain coefficient, and W(ω) is a matrix consisting of a column vector extracted from a right-side unitary matrix corresponding to a zero singular value in a singular value matrix. The singular value matrix is obtained by performing a singular value decomposition on the transfer function matrix G(ω). Also, l(ω) in Equation (2) is represented by the following Equation (3):

$$l(\omega)=e^{j\omega}[1, \ldots ,1]^T \tag{3}$$

For example, if the number of the loudspeakers 3 is M and the number of the first regions (control positions) Re1 is K, then the number of elements of l(ω) becomes M.

Also, according to NBSFC, if the number K of the first regions Re1 is greater than the number M of the loudspeakers 3, then no column vectors can be extracted from the right-side unitary matrix corresponding to a zero singular value in the singular value matrix, and therefore, the filter coefficient vector H'(ω) cannot be calculated. In that case, the filter coefficient vector H'(ω) is calculated by NBSFC under an underdetermined condition.

(3) Operation

Figure 3:
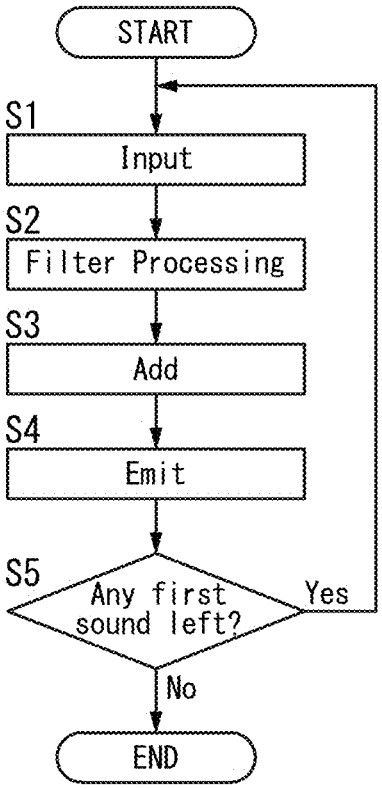
FIG. 3 is a flowchart illustrating how the sound reproduction system operates.

Next, the basic operation of this sound reproduction system 1 will be described with reference to FIG. 3.

First of all, the main computer 2 of the sound reproduction system 1 accepts the input of a first sound emitted from the first sound source 5 and a second sound emitted from the second sound source 6 (in Step S1). The main computer 2 has data about the accepted first and second sounds temporarily stored in a buffer. As for the first sound (target sound), the main computer 2 may accept the input of the first sound sequentially or may have the first sound stored in advance in the buffer.

The main computer 2 reads the data about the first and second sounds from the buffer, and subjects the data about the first sound to signal processing by the first control filters 21 and also subjects the data about the second sound to signal processing by the second control filters 22 (in Step S2). That is to say, the main computer 2 performs filter processing on the data about the first and second sounds. Each of the plurality of first control filters 211-21*n* performs filter processing (signal processing) on the data about the first sound such that the first sound includes a component which becomes louder in the first region Re1 and another component which becomes fainter in the second regions Re2-Re4. Then, each of the plurality of first control filters 211-21*n* outputs the filter processed data to an associated one of the plurality of adders 231-23*n*. Each of the plurality of second control filters 221-22*n* performs filter processing on the data about the second sound such that the sound pressure of a component of the second sound decreases (i.e., a Null space is created) in the first region Re1 and the sound pressure of another component of the second sound increases in the second regions Re2-Re4. Then, each of the plurality of second control filters 221-22*n* outputs the filter processed data to an associated one of the plurality of adders 231-23*n*. Note that each of the first control filters 21 and second control filters 22 may perform the filter processing with data about the first and second sounds read from the buffer either sequentially or collectively at a time.

Each of the plurality of adders 231-23*n* adds together the data about the first sound provided by an associated one of the plurality of first control filters 211-21*n* and the data about the second sound provided by an associated one of the plurality of second control filters 221-22*n*. Then, each of the plurality of adders 231-23*n* outputs the sum of the audio data to an associated one of the plurality of loudspeakers 31-3*n* (in Step S3).

In response, each of the plurality of loudspeakers 31-3*n* emits the first sound and second sound, the data of which has been added together by the associated adder 23, based on the audio data provided (as an electrical signal) by the associated adder 23.

Next, the main computer 2 determines whether or not any first sound to reach the ears of the object person P1 is left in the buffer (in Step S5). If any such first sound is left in the buffer (i.e., if the answer is YES in Step S5), the main computer 2 performs the same series of steps S1-S4 all over again. On the other hand, if no first sound is left in the buffer (i.e., if the answer is NO in Step S5), then the main computer 2 ends the process.

(4) Simulations

Next, the simulations that the present inventors carried out to confirm the effectiveness of the sound reproduction system 1 will be described.

(4.1) Measurement of Propagation Characteristic

In this embodiment, the object space SP10 of the mobile object 10 is supposed to be the vehicle cabin of a passenger car (see FIG. 2). Specifically, in this embodiment, sixteen loudspeakers 3 are arranged in a U-pattern in front, and on the right and left, of the object space SP10 of the mobile object 10. However, this is only an example and should not be construed as limiting. The loudspeakers 3 do not have to be arranged in the U-pattern, but may also be arranged in any other appropriate pattern.

Also, in this embodiment, the four spaces, namely, the first space SP1 and second spaces SP2-SP4, included in the object space SP10 of the mobile object 10 are also measurement ranges (hereinafter referred to as "measurement ranges SP1-SP4"). Specifically, in this embodiment, measurement is carried out at 64 points in each of the measurement ranges SP1-SP4, and the interval between each pair of adjacent measurement points is 8 centimeters [cm].

(4.2) First Control Filters

The results of simulations of the first control filters 21 will be described. In this embodiment, the simulations are carried out within a frequency range of 125 Hz to 2,000 Hz.

(4.2.1) Weighted Least Squares Method

Figure 4A:
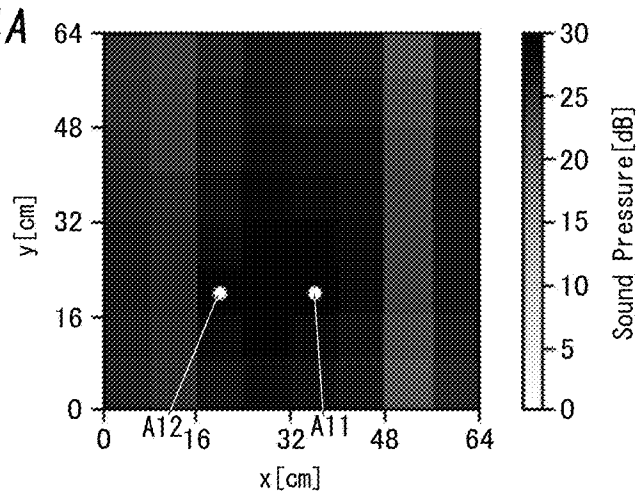
FIGS. 4A to 4D are graphs showing results of measurement obtained by the sound reproduction system using a control filter that adopts a weighted least squares method.
Figure 4B:
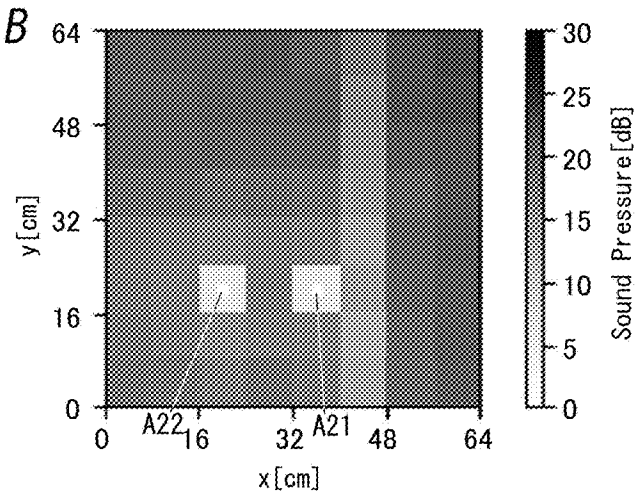
Figure 4C:
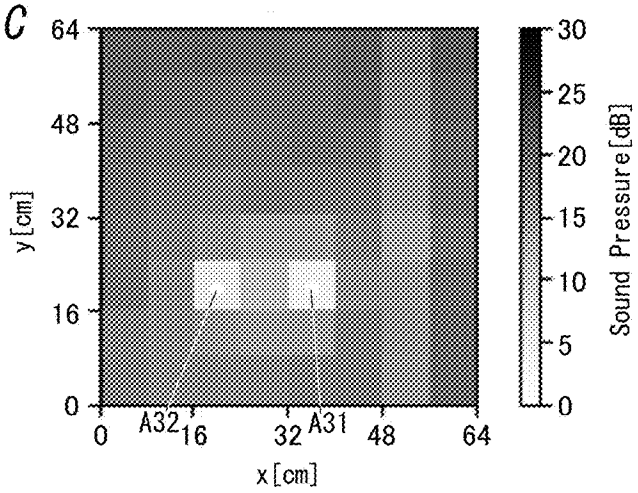
Figure 4D:
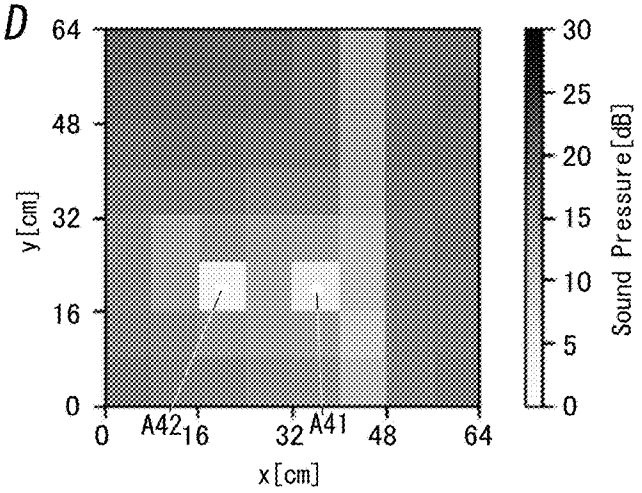

FIGS. 4A-4D show the results of simulations of the first control filters 21 by the weighted least squares method. FIG. 4A shows the results of the simulation of the first space (measurement range) SP1 of the mobile object 10. In FIG. 4A, the reference sign A11 indicates the position of the object person's P1 right ear, and the reference sign A12 indicates the position of the object person's P1 left ear. FIG. 4B shows the results of the simulation of the second space (measurement range) SP2 of the mobile object 10. In FIG. 4B, the reference sign A21 indicates the position of the non-object person's P2 right ear, and the reference sign A22 indicates the position of the non-object person's P2 left ear. FIG. 4C shows the results of the simulation of the second space (measurement range) SP3 of the mobile object 10. In FIG. 4C, the reference sign A31 indicates the position of the non-object person's P3 right ear, and the reference sign A32 indicates the position of the non-object person's P3 left ear. FIG. 4D shows the results of the simulation of the second space (measurement range) SP4 of the mobile object 10. In FIG. 4D, the reference sign A41 indicates the position of the non-object person's P4 right ear, and the reference sign A42 indicates the position of the non-object person's P4 left ear. In FIGS. 4A-4D, the abscissa indicates the distance measured rightward from the origin O1, O2, O3, or O4 of each of the four spaces SP1-SP4 shown in FIG. 2, while the ordinate indicates the distance measured upward from the origin O1, O2, O3, or O4. The same statement is applicable to FIGS. 5A-5D, FIGS. 6A-6D, and FIGS. 8A-8D as well. Also, in FIGS. 4A-4D, the sound pressure at each point of measurement is represented by its shade. Specifically, the darker the shade is, the higher the sound pressure at the point of measurement is. The lighter the shade is, the lower the sound pressure at the point of measurement is. The same statement is applicable to FIGS. 5A-5D, FIGS. 6A-6D, and FIGS. 8A-8D as well.

In FIG. 4A, the sound pressure of a component of the first sound is the highest (e.g., about 30 decibels [dB]) at the right and left ears of the object person P1 present in the first space SP1. On the other hand, in FIGS. 4B-4D, the sound pressure of another component of the first sound is the lowest (e.g., about 5 dB) at the right and left ears of the non-object persons P2-P4 present in the second spaces SP2-SP4, respectively. As can be seen, using the first control filters 21 that adopt the weighted least squares method resulted in a sound pressure difference of about 25 dB between the former component of the first sound in the first region Re1 covering the right and left ears of the object person P1 and the latter component of the first sound in the second regions Re2-Re4, each covering the right and left ears of an associated one of the non-object persons P2-P4. That is to say, this allows the sound pressure of the first sound to be focused toward the first region Re1 and to be decreased in the second regions Re2-Re4.

(4.2.2) Truncated Singular Value Decomposition

Figure 5A:
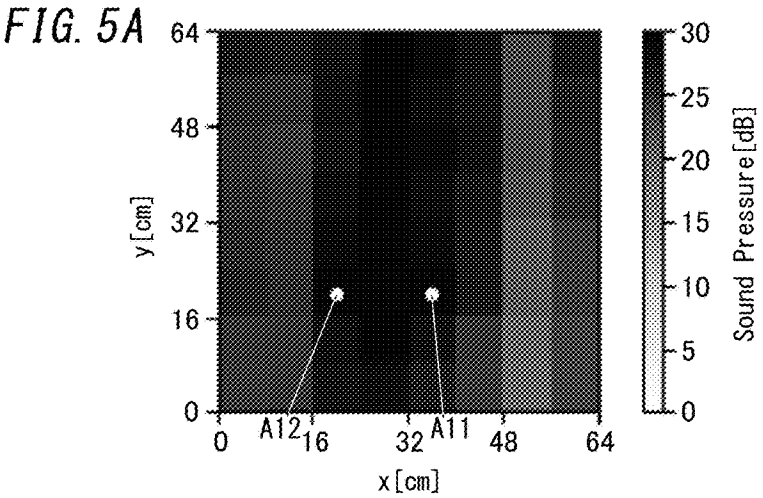
FIGS. 5A to 5D are graphs showing results of measurement obtained by a sound reproduction system according to a comparative example using a control filter that adopts a truncated singular value decomposition.
Figure 5B:
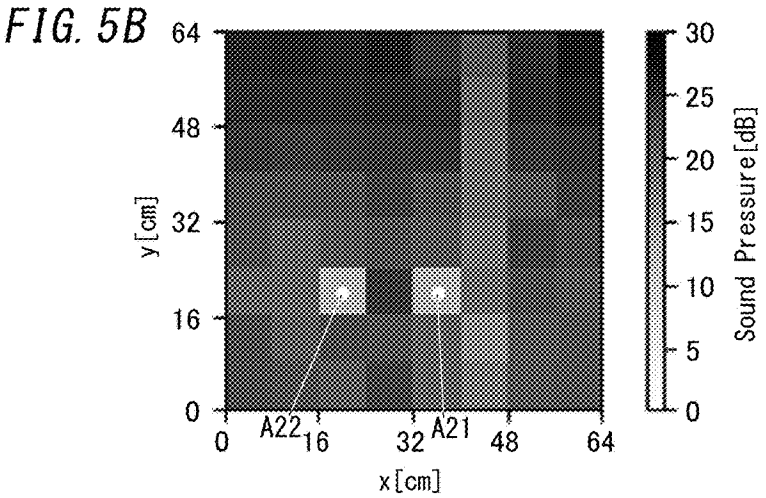
Figure 5C:
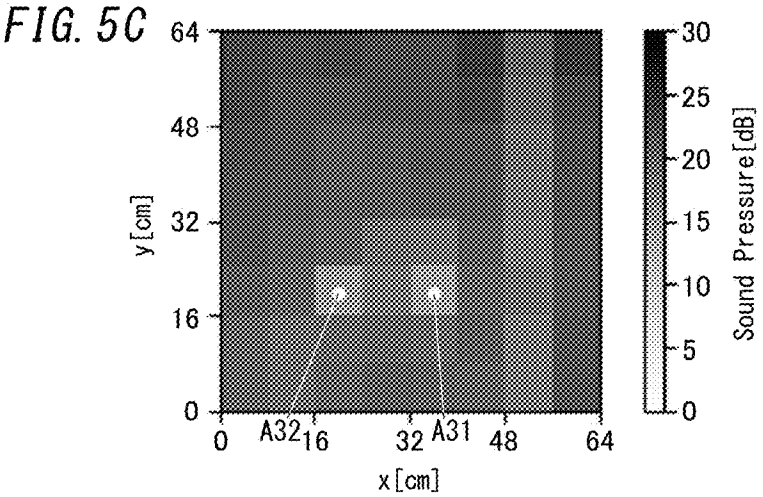
Figure 5D:
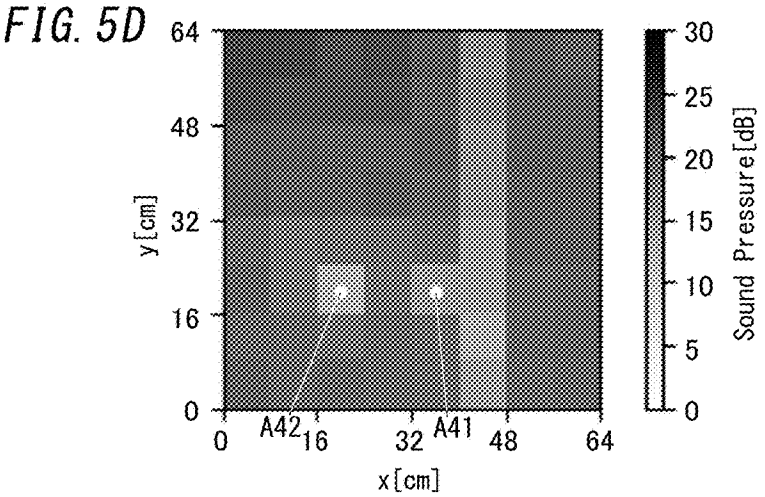

FIGS. 5A-5D show the results of simulations of the first control filters 21 by the truncated singular value decomposition. FIG. 5A shows, just like FIG. 4A, the results of the simulation of the first space (measurement range) SP1 of the mobile object 10. FIG. 5B shows, just like FIG. 4B, the results of the simulation of the second space (measurement range) SP2 of the mobile object 10. FIG. 5C shows, just like FIG. 4C, the results of the simulation of the second space (measurement range) SP3 of the mobile object 10. FIG. 5D shows, just like FIG. 4D, the results of the simulation of the second space (measurement range) SP4 of the mobile object 10.

In FIG. 5A, the sound pressure of a component of the first sound is the highest (e.g., about 30 decibels [dB]) at the right and left ears of the object person P1 present in the first space SP1. On the other hand, in FIGS. 5B-5D, the sound pressure of another component of the first sound is the lowest (e.g., about 13 dB) at the right and left ears of the non-object persons P2-P4 present in the second spaces SP2-SP4, respectively. As can be seen, using the first control filters 21 that adopt the truncated singular value decomposition resulted in a sound pressure difference of about 17 dB between the former component of the first sound in the first region Re1 and the latter component of the first sound in the second regions Re2-Re4.

(4.2.3) Least Squares Method

Figure 6A:
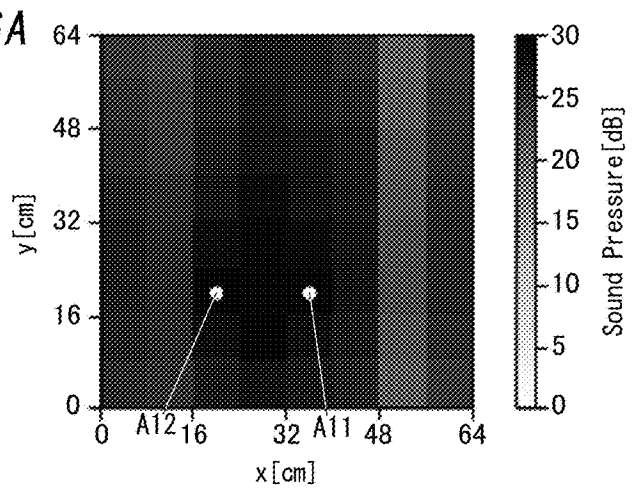
FIGS. 6A to 6D are graphs showing results of measurement obtained by a sound reproduction system according to another comparative example using a control filter that adopts a least squares method.
Figure 6B:
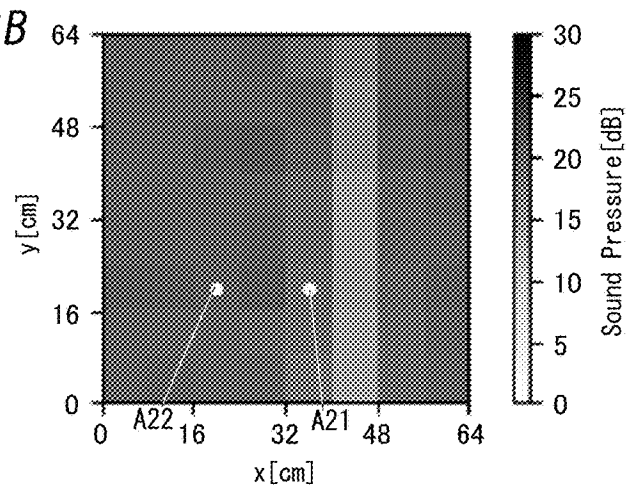
Figure 6C:
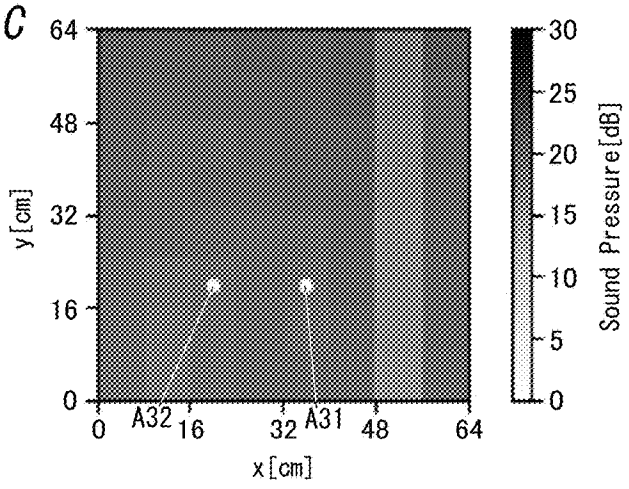
Figure 6D:
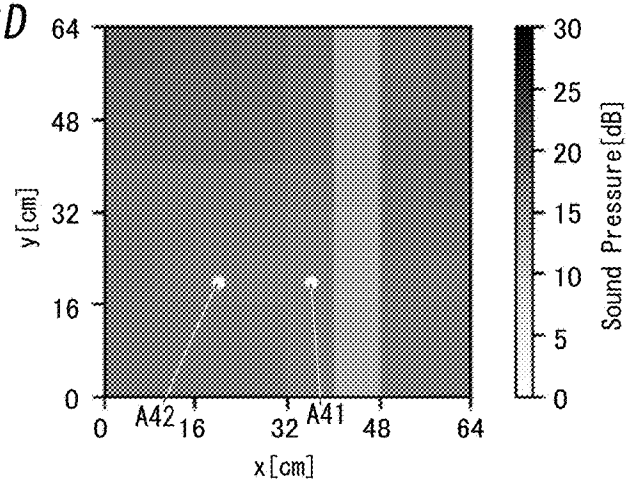

FIGS. 6A-6D show the results of simulations of the first control filters 21 by the least squares method. FIG. 6A shows, just like FIG. 4A, the results of the simulation of the first space (measurement range) SP1 of the mobile object 10. FIG. 6B shows, just like FIG. 4B, the results of the simulation of the second space (measurement range) SP2 of the mobile object 10. FIG. 6C shows, just like FIG. 4C, the results of the simulation of the second space (measurement range) SP3 of the mobile object 10. FIG. 6D shows, just like FIG. 4D, the results of the simulation of the second space (measurement range) SP4 of the mobile object 10.

In FIG. 6A, the sound pressure of a component of the first sound is the highest (e.g., about 30 decibels [dB]) at the right and left ears of the object person P1 present in the first space SP1. On the other hand, in FIGS. 6B-6D, the sound pressure of another component of the first sound is the lowest (e.g., about 20 dB) at the right and left ears of the non-object persons P2-P4 present in the second spaces SP2-SP4, respectively. As can be seen, using the first control filters 21 that adopt the least squares method resulted in a sound pressure difference of about 10 dB between the former component of the first sound in the first region Re1 and the latter component of the first sound in the second regions Re2-Re4.

(4.2.4) Results

Figure 7:
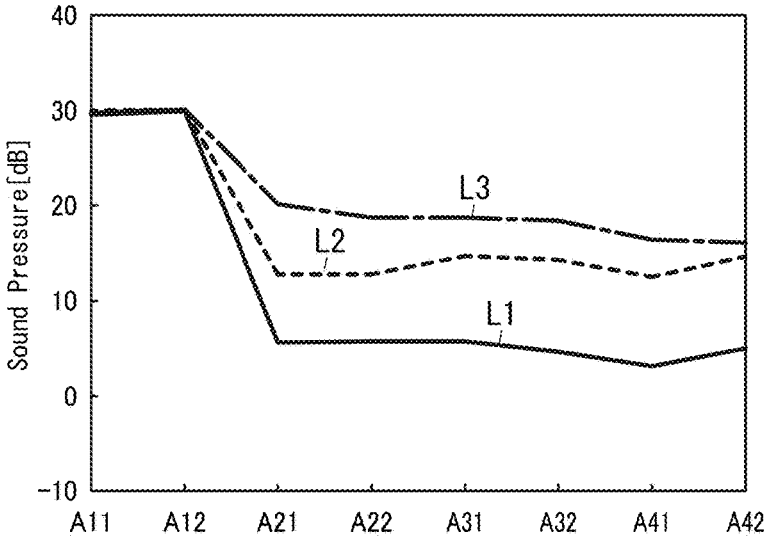
FIG. 7 is a graph showing how the sound pressure is reduced by the control filters that adopt the weighted least squares method, the truncated singular value decomposition, and the least squares method, respectively.

FIG. 7 is a graph showing, based on the results of the simulations shown in FIGS. 4A-6D, how effectively the sound pressure could be decreased by the respective methods. In FIG. 7, the abscissa indicates the positions of the right and left ears A11 and A12 of the object person P1 and the respective positions A21, A22, A31, A32, A41, and A42 of the right and left ears of the non-object persons P2-P4, while the ordinate indicates the sound pressure. In FIG. 7, the solid line graph L1, the dashed line graph L2, and the one-dot-chain line graph L3 indicate the results obtained by the weighted least squares method, the truncated singular value decomposition, and the least squares method, respectively.

As can be seen from FIG. 7, the difference in sound pressure between the first space SP1 and the second spaces SP2-SP4 is the most significant (e.g., about 25 dB) in the case of the weighted least squares method, the second most significant (e.g., about 17 dB) in the case of the truncated singular value decomposition, and the least significant (e.g., about 10 dB) in the case of the least squares method. Thus, using the first control filters 21 that adopt the weighted least squares method allows the difference in sound pressure between the first space SP1 and the second spaces SP2-SP4 to be increased compared to adopting the truncated singular value decomposition or the least squares method. This makes a component of the first sound clearly audible in the first region Re1 and another component of the first sound less clearly audible in the second regions Re2-Re4.

(4.3) Second Control Filters

The results of simulations of the second control filters 22 will be described. In this embodiment, the simulations are carried out within a frequency range of 125 Hz to 2,000 Hz.

Figure 8A:
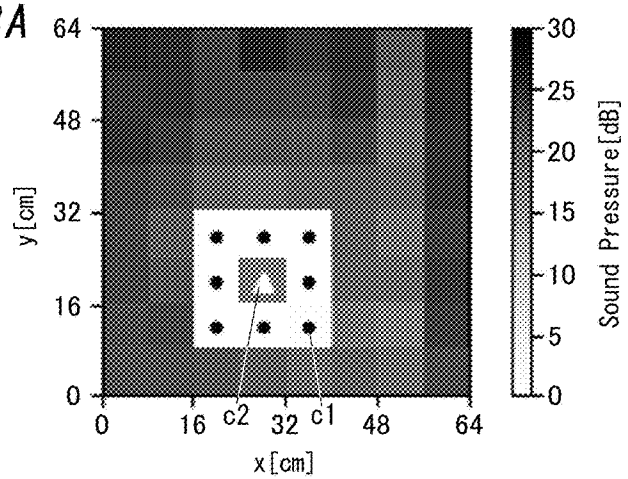
FIGS. 8A to 8D are graphs showing the results of measurement obtained by the sound reproduction system using a control filter that adopts NBSFC.
Figure 8B:
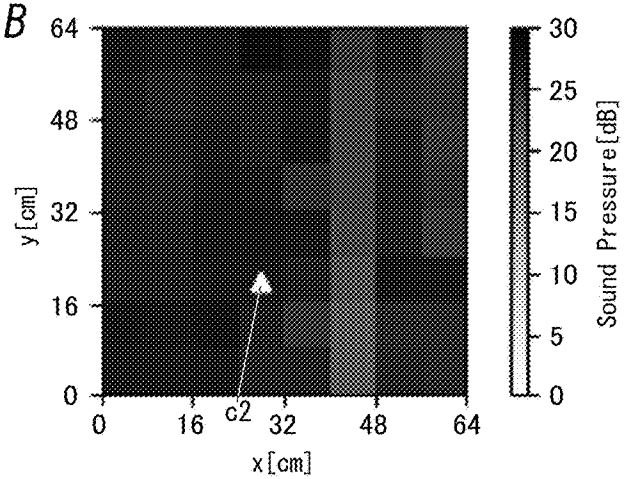
Figure 8C:
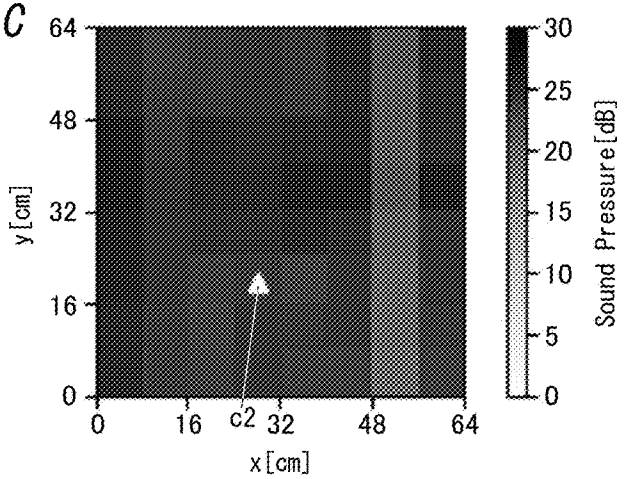
Figure 8D:
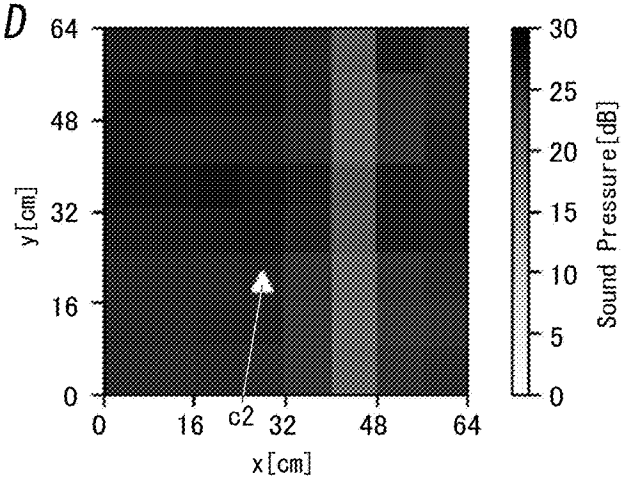

FIG. 8A shows, just like FIG. 4A, the results of the simulation of the first space (measurement range) SP1 of the mobile object 10. FIG. 8B shows, just like FIG. 4B, the results of the simulation of the second space (measurement range) SP2 of the mobile object 10. FIG. 8C shows, just like FIG. 4C, the results of the simulation of the second space (measurement range) SP3 of the mobile object 10. FIG. 8D shows, just like FIG. 4D, the results of the simulation of the second space (measurement range) SP4 of the mobile object 10.

In FIG. 8A, the solid dots c1 indicate the points of control by the second control filters 22, i.e., Null points for the second sound. In FIGS. 8A-8D, the open triangle c2 indicates the point of control by the first control filters 21, i.e., a point toward which the sound pressure of the first sound needs to be focused.

In FIG. 8A, the second control filters 22 allow a region where the sound pressure goes nearly equal to zero (i.e., a Null region) to be defined around the control point c2 in the first space SP1 where the object person P1 is present. On the other hand, in the second spaces SP2-SP4 where the non-object persons P2-P4 are respectively present, no such regions where the sound pressure goes nearly equal to zero are defined around the control point c2 as shown in FIGS. 8B-8D. In other words, the sound pressure of a component of the second sound emitted from the loudspeakers 3 toward the second regions Re2-Re4 is equal to the predetermined value.

Figure 9:
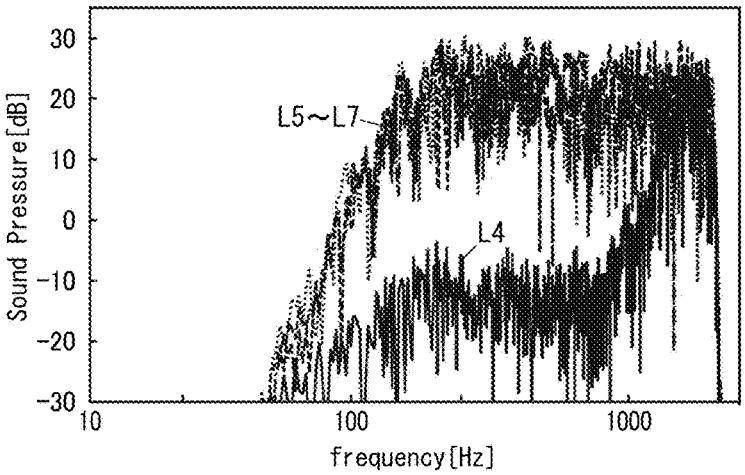
FIG. 9 is a graph showing how the sound pressure is reduced by the control filter that adopts the NBSFC in the sound reproduction system.

FIG. 9 is a graph showing the sound pressure at the control point c2 shown in FIGS. 8A-8D, i.e., the sound pressure of the second sound. In FIG. 9, the abscissa indicates the frequency and the ordinate indicates the sound pressure. Note that the frequency is plotted in log (logarithmic) scale. In FIG. 9, L4 indicates the sound pressure in the first space SP1 and L5-L7 indicate the sound pressures in the second spaces SP2-SP4.

As can be seen from FIG. 9, using the second control filters 22 that adopt NBSFC resulted in a sound pressure difference of about 20 dB between a component of the second sound in the first space SP1 and another component of the second sound in the second spaces SP2-SP4. That is to say, adopting NBSFC as a calculation method for the second control filters 22 allows a Null region with a low sound pressure to be defined in the first space SP1. In FIG. 9, as the frequency increases, the sound pressure difference between the first space SP1 and the second spaces SP2-SP4 decreases to make it increasingly difficult to define the Null region. The reason is that the wavelength shortens as the frequency increases. Even in such a situation, the Null region may still be defined by narrowing the interval between respective control points (points of measurement).

(5) Advantage

The sound reproduction system 1 according to this embodiment performs signal processing on the first sound (target sound) emitted from the first sound source 5 in accordance with the first control characteristic and also performs signal processing on the second sound (masker) emitted from the second sound source 6 in accordance with the second control characteristic. This allows the sound pressure of a component of the first sound to be increased, and the sound pressure of a component of the second sound to be decreased, with respect to the first region Re1 occupied by the object person P1. This also allows the sound pressure of another component of the first sound to be decreased, and the sound pressure of another component of the second sound to be increased, with respect to the second regions Re2-Re4 occupied by the non-object persons P2-P4, respectively. This makes the former component of the first sound clearly audible in the first region Re1 and the latter component of the first sound less clearly audible in the second regions Re2-Re4.

(6) Variations

Note that the first embodiment described above is only one of numerous embodiments of the present disclosure. The first embodiment is readily modified, replaced, or combined with any of various other embodiments depending on the design choice or any other factor, as long as an object of the present disclosure is achievable. Also, functions similar to those of this sound reproduction system 1 are implementable as a sound reproduction method, a (computer) program, or a non-transitory computer readable storage medium having stored the program thereon. A sound reproduction method according to an aspect is designed to emit a first sound and a second sound from a loudspeaker 3 at a time. The first sound is intended to reach the ears of an object person's P1. The second sound is intended to reach the ears of non-object persons' P2-P4 and compliant with a control characteristic. The control characteristic is defined such that the second sound includes a component which is emitted from the loudspeaker 3 toward a first region Re1 and has a sound pressure lower than a predetermined value, and another component which is emitted from the loudspeaker 3 toward second regions Re2-Re4 and has a sound pressure equal to the predetermined value. The first region Re1 is a region occupied by the object person P1. The second regions Re2-Re4 are regions occupied by the non-object persons P2-P4.

A first variation of the first embodiment will be described. Note that the variations to be described below may be combined as appropriate.

(6.1) First Variation

Figure 10:
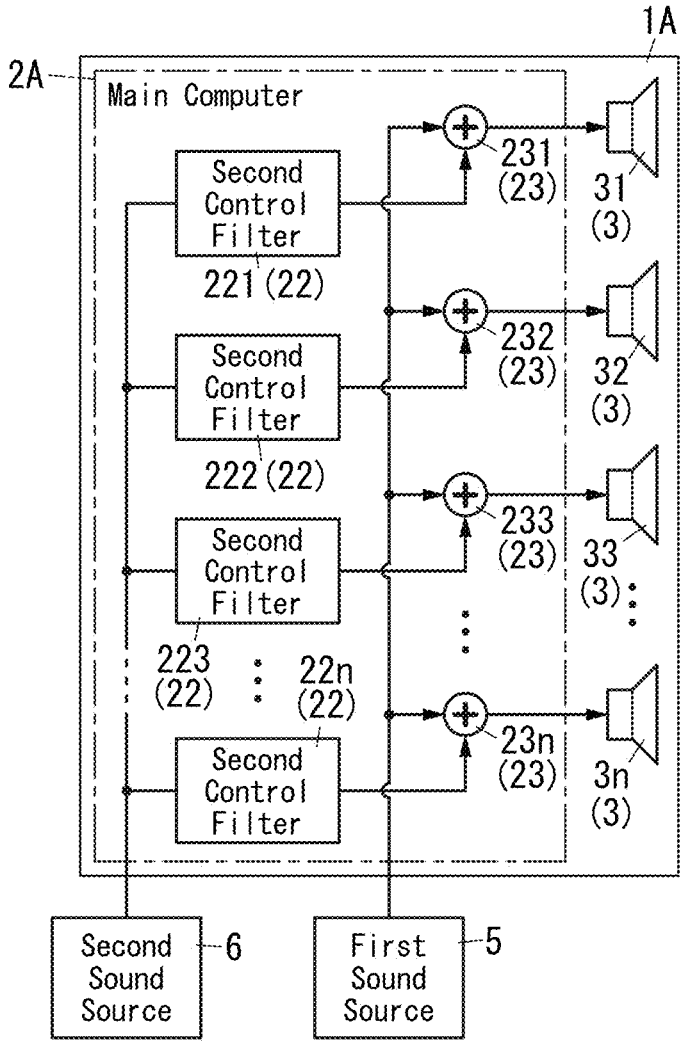
FIG. 10 is a block diagram of a sound reproduction system according to a variation of the first embodiment.

In the first embodiment described above, the sound reproduction system 1 is supposed to include both of the first control filters 21 and the second control filters 22 as shown in FIG. 1. However, this is only an example and should not be construed as limiting. Alternatively, the sound reproduction system 1A may include only the second control filters 22 without the first control filters 21 as shown in FIG. 10. Specifically, in such a variation, the second control filters 22 sets the sound pressure of a component of the second sound emitted from the loudspeakers 3 toward the first region Re1 at a pressure lower than a predetermined value and also sets the sound pressure of another component of the second sound emitted from the loudspeakers 3 toward the second regions Re2-Re4 at the predetermined value. This makes the former component of the second sound emitted toward the first region Re1 fainter and the latter component of the second sound emitted toward the second regions Re2-Re4 louder. Thus, even if the sound pressure of the former component of the first sound emitted toward the first region Re1 is as high as that of the latter component of the first sound emitted toward the second regions Re2-Re4, the former component of the first sound is allowed to be made clearly audible in the first region Re1 and the latter component of the first sound is allowed to be made less clearly audible in the second regions Re2-Re4. Note that the sound reproduction system 1A according to this first variation has the same configuration as the sound reproduction system 1 according to the first embodiment except that the first control filters 21 are omitted, and therefore, a detailed description thereof will be omitted herein.

(6.2) Other Variations

Next, other variations will be enumerated.

The sound reproduction system 1 according to the present disclosure includes a computer system as the main computer 2, for example. The computer system includes, as its major constituent elements, hardware components such as a processor and a memory. The processor's executing a program stored in the memory of the computer system allows the function of the sound reproduction system 1 according to the present disclosure to be performed. The program may be stored in advance in the memory of the computer system, downloaded via a telecommunications line such as the Internet, or distributed after having been stored in a non-transitory computer-readable storage medium such as a memory card, an optical disc or a hard disk drive. The processor of the computer system is configured as a single or plurality of electronic circuits including a semiconductor integrated circuit (IC) or a largescale integrated circuit (LSI). The plurality of electronic circuits may be either integrated together in a single chip or distributed in multiple chips. Those chips may be assembled together in a single device or distributed in multiple devices.

Also, the plurality of functions of the sound reproduction system 1 does not have to be aggregated together in a single housing. Rather, the respective constituent elements of the sound reproduction system 1 may be distributed in multiple housings. Optionally, at least some of the functions of the sound reproduction system 1 may be performed by a server and cloud computing system, for example.

Furthermore, in the first embodiment described above, the loudspeakers 3 form part of the sound reproduction system 1. However, this is only an example and should not be construed as limiting. Alternatively, the loudspeakers 3 may also be installed in advance in the mobile object 10.

Furthermore, the mobile object 10 does not have to be a passenger car but may also be an airplane, a train, or any other type of vehicle as long as the mobile object 10 is configured to move with a passenger in it. Furthermore, the ambient sound does not have to be a pink noise or a road noise, but may also be an engine sound, a wind noise, or any other ambient sound.

Second Embodiment

A sound reproduction system 1B according to a second embodiment is designed to readily change, on a frequency basis, the output level of a second sound emitted from the second sound source 6, which is a major difference from the sound reproduction system 1 according to the first embodiment. In the other respects, however, the sound reproduction system 1B has the same configuration as the counterpart of the first embodiment. Thus, in the following description, any constituent member of this second embodiment, having the same function as the counterpart of the first embodiment described above, will be designated by the same reference numeral as that counterpart's, and a detailed description thereof will be omitted herein.

Figure 11:
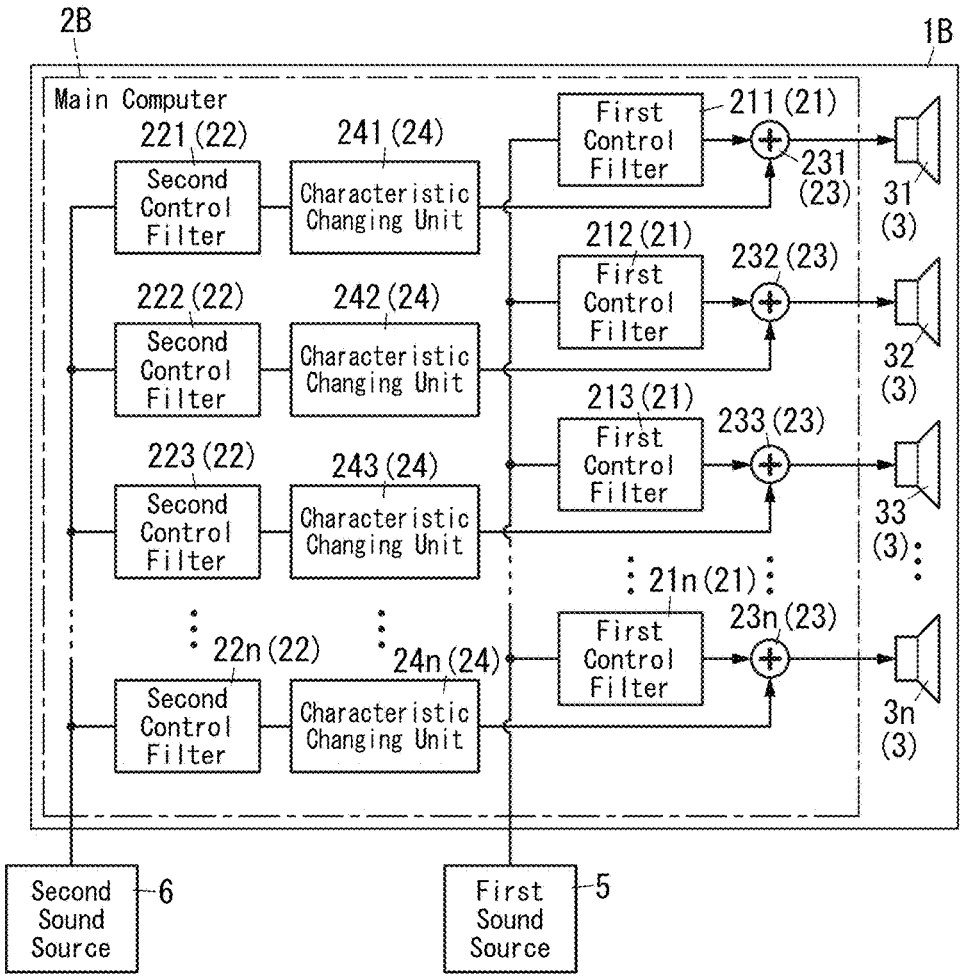
FIG. 11 is a block diagram of a sound reproduction system according to a second embodiment.

A sound reproduction system 1B according to the second embodiment includes a main computer 2B and at least one loudspeaker 31-3*n* (where n=1, 2, and so on) as shown in FIG. 11. The main computer 2B includes at least one first control filter 211-21*n* (where n=1, 2, and so on), at least one second control filter 221-22*n* (where n=1, 2, and so on), and at least one adder 231-23*n* (where n=1, 2, and so on). The main computer 2B further includes at least one characteristic changing unit 241-24*n* (where n=1, 2, and so on). In the following description, when a plurality of characteristic changing units 241-24*n* are provided, the plurality of characteristic changing units 241-24*n* will be hereinafter collectively referred to as "characteristic changing units 24" if there is no need to distinguish them from each other.

The characteristic changing units 24 may be each implemented as an equalizer with the ability to change the output level of a sound on a frequency basis, for example. Specifically, each of the characteristic changing units 24 changes, on a frequency basis, the gain of an audio signal (data) representing the second sound and supplied from an associated one of the second control filters 22. According to this embodiment, the frequency characteristics of ambient sounds (including a road noise and a wind noise) for a traveling passenger car (which is an exemplary mobile object 10) are stored in advance in the characteristic changing units 24. As used herein, the "frequency characteristics" refer to the gains for respective frequency bands of signals representing the ambient sounds. The characteristic changing units 24 change the frequency characteristics of the second sound adaptively to the frequency characteristics of the ambient sounds. Specifically, the characteristic changing units 24 change, on a frequency basis, the gain of an audio signal representing the second sound such that the gains of the ambient sounds for a given frequency band match the gain of the second sound for that frequency band. As used herein, if some value "matches" another value, these two values may naturally perfectly match each other, but may also match each other only imperfectly.

The sound reproduction system 1B according to this embodiment allows the second sound to more closely simulate the ambient sounds by changing, on a frequency basis, the output level of the second sound adaptively to the ambient sounds. This prevents the non-object persons P2-P4 from finding the second sound unnatural, while making a component of the first sound less clearly audible to the non-object persons P2-P4.

In the embodiment described above, the output level of the second sound is changed on a frequency basis as an exemplary frequency characteristic of the second sound. However, this is only an example and should not be construed as limiting. For example, in a situation where the frequency of the road noise varies as the velocity of the mobile object 10 changes, the frequency of the second sound itself may be changed. In other words, the frequency of the second sound may be changed as an exemplary frequency characteristic of the second sound.

In this embodiment, the characteristic changing units 24 form part of the sound reproduction system 1B. However, this is only an example and should not be construed as limiting. Alternatively, the characteristic changing units 24 may also be provided outside of the sound reproduction system 1B.

Optionally, any of the configurations just described for this second embodiment (including variations thereof) may be combined as appropriate with any of the configurations described above for the first embodiment (including variations thereof).

Third Embodiment

A sound reproduction system 1C according to a third embodiment includes an information acquisition unit 25 configured to acquire information about the velocity of the mobile object 10, which is a major difference from the sound reproduction system 1B according to the second embodiment. In the other respects, however, the sound reproduction system 1C has the same configuration as the counterpart of the second embodiment. Thus, in the following description, any constituent member of this third embodiment, having the same function as the counterpart of the second embodiment described above, will be designated by the same reference numeral as that counterpart's, and a detailed description thereof will be omitted herein.

Figure 12:
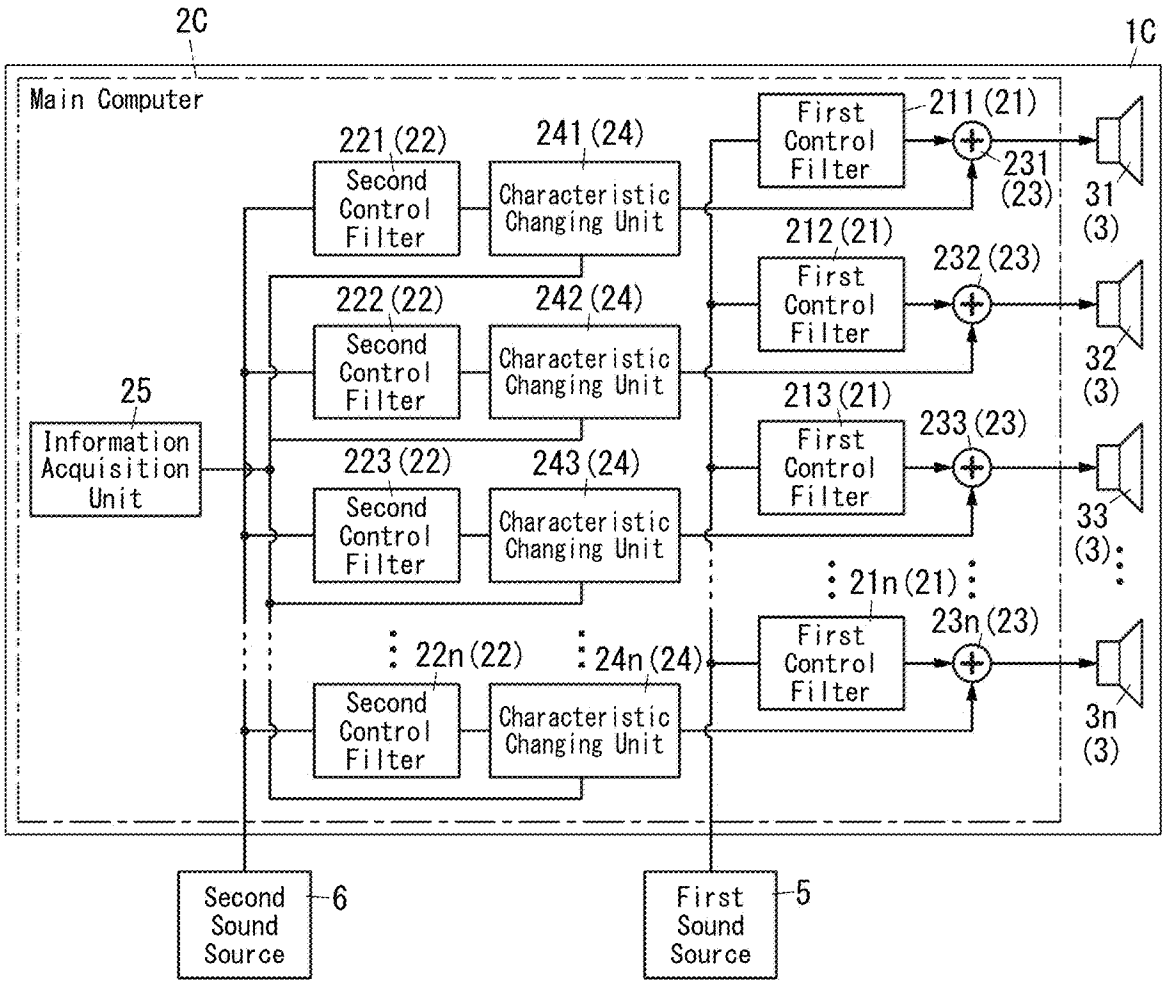
FIG. 12 is a block diagram of a sound reproduction system according to a third embodiment.

A sound reproduction system 1C according to this embodiment includes a main computer 2C and at least one loudspeaker 31-3*n* (where n=1, 2, and so on) as shown in FIG. 12. The main computer 2C includes at least one first control filter 211-21*n* (where n=1, 2, and so on), at least one second control filter 221-22*n* (where n=1, 2, and so on), and at least one adder 231-23*n* (where n=1, 2, and so on). The main computer 2C further includes at least one characteristic changing unit 241-24*n* (where n=1, 2, and so on) and an information acquisition unit 25.

The information acquisition unit 25 may acquire information about the velocity of the mobile object 10 from a main computer of the mobile object 10, for example.

The characteristic changing units 24 changes, on a frequency basis, the output level of the second sound in accordance with the information, provided by the information acquisition unit 25, about the velocity of the mobile object 10. In other words, the characteristic changing units 24 change the frequency characteristic of the second sound in accordance with external information.

The sound reproduction system 1C according to this embodiment is allowed to change the frequency characteristic of the second sound adaptively to the velocity of the mobile object 10. This prevents the non-object persons P2-P4 from finding the second sound unnatural, while making a component of the first sound less clearly audible to the non-object persons P2-P4.

Optionally, any of the configurations just described for this third embodiment (including variations thereof) may be combined as appropriate with any of the configurations described above for the first and second embodiments (including variations thereof).

Fourth Embodiment

A sound reproduction system 1D according to a fourth embodiment includes an analysis unit 26 configured to analyze, on a frequency basis, the output level of an ambient sound picked up by a microphone 4, which is a major difference from the sound reproduction system 1B according to the second embodiment. In the other respects, however, the sound reproduction system 1D has the same configuration as the counterpart of the second embodiment. Thus, in the following description, any constituent member of this fourth embodiment, having the same function as the counterpart of the second embodiment described above, will be designated by the same reference numeral as that counterpart's, and a detailed description thereof will be omitted herein.

Figure 13:
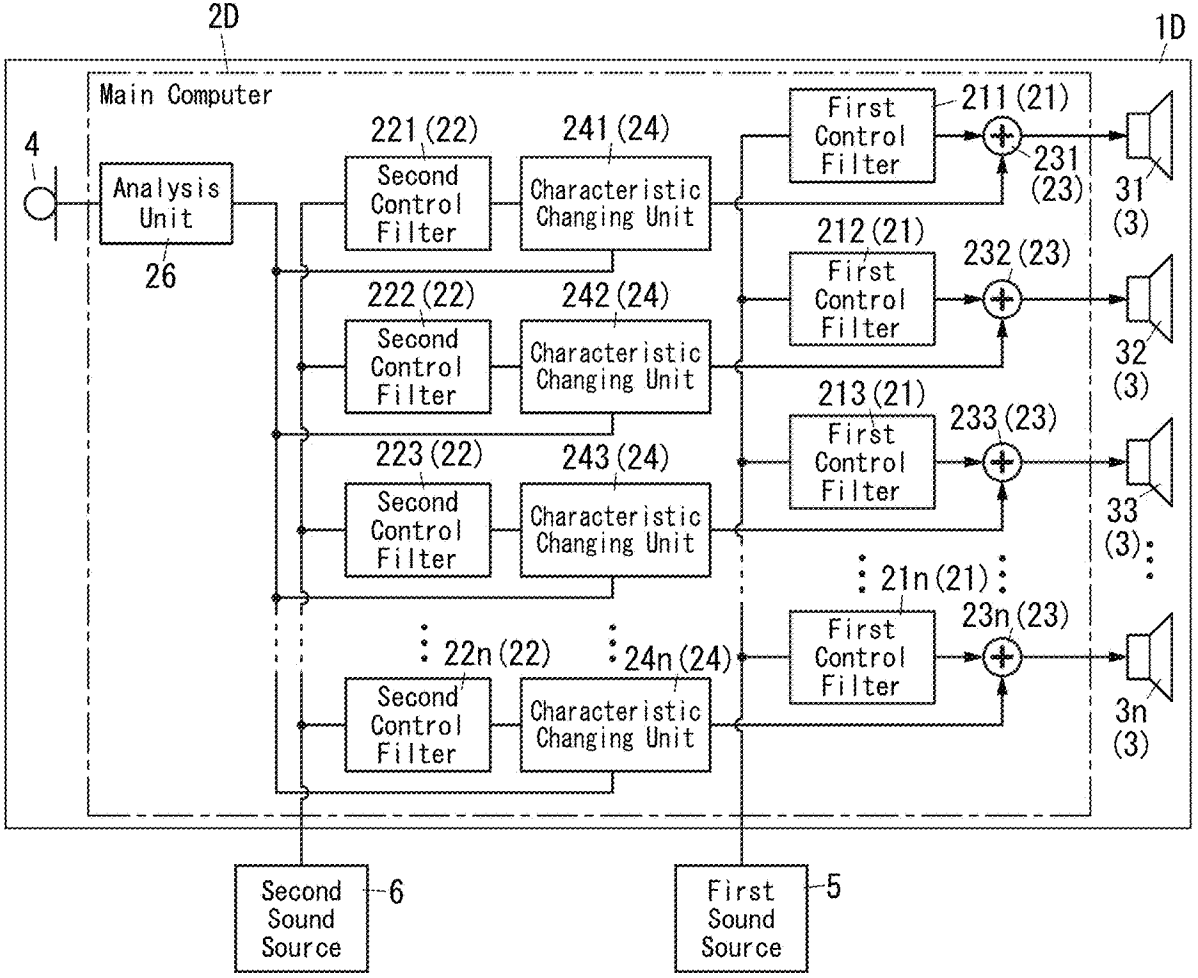
FIG. 13 is a block diagram of a sound reproduction system according to a fourth embodiment.

A sound reproduction system 1D according to this embodiment includes a main computer 2D and at least one loudspeaker 31-3*n* (where n=1, 2, and so on) as shown in FIG. 13. The main computer 2D includes at least one first control filter 211-21*n* (where n=1, 2, and so on), at least one second control filter 221-22*n* (where n=1, 2, and so on), and at least one adder 231-23*n* (where n=1, 2, and so on). The main computer 2D further includes at least one characteristic changing unit 241-24*n* (where n=1, 2, and so on), a microphone 4, and an analysis unit 26. In this embodiment, the sound reproduction system 1D includes the microphone 4. However, this is only an example and should not be construed as limiting. Alternatively, the microphone 4 may be installed in advance in the mobile object 10. In other words, the microphone 4 does not have to form part of the sound reproduction system 1D.

The microphone 4 is attached to the mobile object 10 to pick up ambient sounds (such as a road noise and a wind noise) from around the mobile object 10. The microphone 4 converts the ambient sounds thus picked up into an electrical signal and output the electrical signal to the analysis unit 26.

The analysis unit 26 analyzes, on a frequency basis, the output levels of the ambient sounds in accordance with the electrical signal supplied from the microphone 4.

The characteristic changing units 24 change, on a frequency basis, the output level of the second sound based on the result of analysis by the analysis unit 26. Specifically, the characteristic changing units 24 change, on a frequency basis, the gain of an audio signal representing the second sound such that the output levels (gains) of the ambient sounds for a given frequency band match the output level (gain) of the second sound for that frequency band. As used herein, if some value "matches" another value, these two values may naturally perfectly match each other, but may also match each other only imperfectly.

The sound reproduction system 1D according to this embodiment changes the frequency characteristic of the second sound based on actual ambient sounds picked up by the microphone 4, and therefore, allows the second sound to even more closely simulate the ambient sounds than the sound reproduction system 1B according to the second embodiment does.

In the fourth embodiment, a single microphone 4 and a single analysis unit 26 are provided. However, this is only an example and should not be construed as limiting. Alternatively, a plurality of microphones 4 and a plurality of analysis units 26 may be provided. Also, the number of the microphones 4 provided may be either the same as, or different from, that of the analysis units 26 provided.

Optionally, the information acquisition unit 25 described for the third embodiment and the microphone 4 and analysis unit 26 described for this embodiment may be used in combination.

Furthermore, any of the configurations just described for this fourth embodiment (including variations thereof) may be combined as appropriate with any of the configurations described above for the first, second, and third embodiments (including variations thereof).

(Resume)

As can be seen from the foregoing description of embodiments, a sound reproduction system (1, 1A-1D) according to a first aspect of the present disclosure is configured to emit a first sound and a second sound from a loudspeaker (3) at a time. The first sound is intended to reach ears of an object person's (P1). The second sound is intended to reach ears of a non-object person's (P2-P4) and compliant with a control characteristic. The control characteristic is defined such that the second sound includes a component which is emitted from the loudspeaker (3) toward a first region (Re1) occupied by the object person (P1) and has a sound pressure lower than a predetermined value, and another component which is emitted from the loudspeaker (3) toward a second region (Re2-Re4) occupied by the non-object person (P2-P4) and has a sound pressure equal to the predetermined value.

According to this configuration, the sound pressure of a component, emitted toward the first region (Re1), of the second sound is set at a relatively low pressure, and the sound pressure of another component, emitted toward the second region (Re2-Re4), of the second sound is set at a relatively high pressure. This makes a component of the first sound clearly audible in the first region (Re1) and another component of the first sound less clearly audible in the second region (Re2-Re4).

In a sound reproduction system (1, 1A-1D) according to a second aspect, which may be implemented in conjunction with the first aspect, the first sound compliant with a first control characteristic and the second sound compliant with a second control characteristic different from the first control characteristic are emitted from the loudspeaker (3) at a time. The first control characteristic is defined such that the first sound includes two components, one of which is emitted from the loudspeaker (3) toward the first region (Re1) and the other of which is emitted from the loudspeaker (3) toward the second region (Re2-Re4) and has a lower sound pressure than the former component. The second control characteristic is defined by the control characteristic.

According to this configuration, the sound pressure of the other component, emitted toward the second region (Re2-Re4), of the first sound is also set at a relatively low pressure. This makes the other component of the first sound even less clearly audible in the second region (Re2-Re4).

In a sound reproduction system (1, 1A-1D) according to a third aspect, which may be implemented in conjunction with the first or second aspect, the first region (Re1) is included in a first space (SP1) provided to accommodate the object person (P1). The second region (Re2-Re4) is included in a second space (SP2-SP4) provided to accommodate the non-object person (P2-P4). The first space (SP1) and the second space (SP2) are included in an object space (SP10).

This configuration makes a component of the first sound clearly audible to the object person (P1), and another component of the first sound less clearly audible to the non-object person (P2-P4), in the object space (SP10).

In a sound reproduction system (1, 1A-1D) according to a fourth aspect, which may be implemented in conjunction with the third aspect, the object space (SP10) includes a plurality of the first spaces (SP1).

This configuration allows a plurality of object persons (P1) to catch the first sound.

In a sound reproduction system (1, 1A-1D) according to a fifth aspect, which may be implemented in conjunction with any one of the second to fourth aspects, the second control characteristic is determined by Null-space based sound field control (NBSFC).

This configuration makes the sound pressure of a component, emitted toward the first region (Re1), of the second sound lower than the predetermined pressure, and also makes the sound pressure of another component, emitted toward the second region (Re2-Re4), of the second sound equal to the predetermined pressure.

In a sound reproduction system (1, 1A-1D) according to a sixth aspect, which may be implemented in conjunction with any one of the second to fifth aspects, the first control characteristic is determined by a weighted least squares method.

This configuration makes the sound pressure of a component, emitted toward the second region (Re2-Re4), of the first sound lower than the sound pressure of another component, emitted toward the first region (Re1), of the first sound.

In a sound reproduction system (1B-1D) according to a seventh aspect, which may be implemented in conjunction with any one of the first to sixth aspects, a characteristic changing unit (24) is configured to change a frequency characteristic of a given sound. The sound reproduction system (1B-1D) allows the characteristic changing unit (24) to change a frequency characteristic of the second sound adaptively to an ambient sound.

This configuration allows the second sound, emitted from the loudspeaker (3), to closely simulate an ambient sound, thus preventing the non-object person (P2-P4) from finding the second sound unnatural.

A sound reproduction system (1C) according to an eighth aspect, which may be implemented in conjunction with the seventh aspect, allows the characteristic changing unit (24) to change the frequency characteristic of the second sound in accordance with external information.

This configuration allows the second sound to even more closely simulate the ambient sound in accordance with the external information.

A sound reproduction system (1D) according to a ninth aspect, which may be implemented in conjunction with the seventh or eighth aspect, further includes an analysis unit (26) configured to analyze, on a frequency basis, an output level of the ambient sound picked up by a microphone (4). The sound reproduction system (1D) allows the characteristic changing unit (24) to change, based on a result of analysis by the analysis unit (26), the output level of the second sound on a frequency basis.

This configuration allows the second sound to even more closely simulate the ambient sound based on a result of analysis by the analysis unit (26).

A mobile object (10) according to a tenth aspect includes the sound reproduction system (1, 1A-1D) according to any one of the first to ninth aspects, and a mobile object body (100) equipped with the loudspeaker (3).

This configuration makes a component of the first sound clearly audible to the object person (P1) and another component of the first sound less clearly audible to the non-object person (P2-P4) in the mobile object (10).

A sound reproduction method according to an eleventh aspect is designed to emit a first sound and a second sound from a loudspeaker (3) at a time. The first sound is intended to reach ears of an object person's. The second sound is intended to reach ears of a non-object person's and compliant with a control characteristic. The control characteristic is defined such that the second sound includes a component which is emitted from the loudspeaker (3) toward a first region (Re1) occupied by the object person (P1) and has a sound pressure lower than a predetermined value, and another component which is emitted from the loudspeaker (3) toward a second region (Re2-Re4) occupied by the non-object person (P2-P4) and has a sound pressure equal to the predetermined value.

According to this configuration, the sound pressure of a component, emitted toward the first region (Re1), of the second sound is set at a relatively low pressure and the sound pressure of another component, emitted toward the second region (Re2-Re4), of the second sound is set at a relatively high pressure. This makes a component of the first sound clearly audible in the first region (Re1) and another component of the first sound less clearly audible in the second region (Re2-Re4).

In a sound reproduction system (1B, 1C) according to a twelfth aspect, which may be implemented in conjunction with the seventh aspect, the characteristic changing unit (24) changes a frequency of the second sound as the frequency characteristic of the second sound.

According to this configuration, changing the frequency of the second sound in a situation where the frequency of a road noise is variable with the velocity of the mobile object (10), for example, allows the second sound to more closely simulate the road noise.

A program according to a thirteenth aspect is designed to make a computer system perform processing of emitting a first sound and a second sound from a loudspeaker (3) at a time. The first sound is intended to reach the ears of an object person's (P1). The second sound is intended to reach the ears of a non-object person's (P2-P4) and compliant with a control characteristic. The control characteristic is defined such that the second sound includes a component which is emitted from the loudspeaker (3) toward a first region (Re1) occupied by the object person (P1) and has a sound pressure lower than a predetermined value, and another component which is emitted from the loudspeaker (3) toward a second region (Re2-Re4) occupied by the non-object person (P2-P4) and has a sound pressure equal to the predetermined value.

According to this configuration, the sound pressure of a component, emitted toward the first region (Re1), of the second sound is set at a relatively low pressure and the sound pressure of another component, emitted toward the second region (Re2-Re4), of the second sound is set at a relatively high pressure. This makes a component of the first sound clearly audible in the first region (Re1) and another component of the first sound less clearly audible in the second region (Re2-Re4).

Note that the configurations according to the second to ninth aspects and the twelfth aspect are not essential constituent elements of the sound reproduction system (1, 1A-1D) but may be omitted as appropriate.

While various embodiments have been described herein above, it is to be appreciated that various changes in form and detail may be made without departing from the spirit and scope of the present disclosure presently or hereafter claimed.

The entire contents of Japanese Patent Application No. 2017-209662 mentioned above are incorporated by reference for all purposes.

The invention claimed is:

1. A sound reproduction system configured to emit a first sound and a second sound from a loudspeaker at a time, the first sound being intended to reach ears of an object person, the second sound being intended to reach ears of a non-object person and compliant with a control characteristic, the control characteristic being defined such that the second sound includes a component which is emitted from the loudspeaker toward a first region occupied by the object person and has a sound pressure lower than a predetermined value, and another component which is emitted from the loudspeaker toward a second region occupied by the non-object person and has a sound pressure equal to the predetermined value.

2. The sound reproduction system of claim 1, wherein the first sound compliant with a first control characteristic and the second sound compliant with a second control characteristic different from the first control characteristic are emitted from the loudspeaker at a time, the first control characteristic being defined such that the first sound includes two components, one of which is emitted from the loudspeaker toward the first region and the other of which is emitted from the loudspeaker toward the second region and has a lower sound pressure than said one, the second control characteristic being defined by the control characteristic.

3. The sound reproduction system of claim 1, wherein the first region is included in a first space provided to accommodate the object person, the second region is included in a second space provided to accommodate the non-object person, and the first space and the second space are included in an object space.

4. The sound reproduction system of claim 3, wherein the object space includes a plurality of the first spaces.

5. The sound reproduction system of claim 2, wherein the second control characteristic is determined by Null-space based sound field control.

6. The sound reproduction system of claim 2, wherein the first control characteristic is determined by a weighted least squares method.

7. The sound reproduction system of claim 1, wherein a characteristic changing unit is configured to change a frequency characteristic of a given sound, the sound reproduction system allows the characteristic changing unit to change a frequency characteristic of the second sound adaptively to an ambient sound.

8. The sound reproduction system of claim 7, wherein the sound reproduction system allows the characteristic changing unit to change the frequency characteristic of the second sound in accordance with external information.

9. The sound reproduction system of claim 7, further comprising an analysis unit configured to analyze, on a frequency basis, an output level of the ambient sound picked up by a microphone, wherein the sound reproduction system allows the characteristic changing unit to change, based on a result of analysis by the analysis unit, the output level of the second sound on a frequency basis.

10. A mobile object comprising:

the sound reproduction system of claim 1; and a mobile object body equipped with the loudspeaker.

11. A sound reproduction method for emitting a first sound and a second sound from a loudspeaker at a time, the first sound being intended to reach ears of an object person, the second sound being intended to reach ears of a non-object person and compliant with a control characteristic, the control characteristic being defined such that the second sound includes a component which is emitted from the loudspeaker toward a first region occupied by the object person and has a sound pressure lower than a predetermined value, and another component which is emitted from the loudspeaker toward a second region occupied by the non-object person and has a sound pressure equal to the predetermined value.

12. The sound reproduction system of claim 7, wherein the characteristic changing unit changes a frequency of the second sound as the frequency characteristic of the second sound.

13. The sound reproduction system of claim 2, wherein the first region is included in a first space provided to accommodate the object person, the second region is included in a second space provided to accommodate the non-object person, and the first space and the second space are included in an object space.

14. The sound reproduction system of claim 3, wherein the second control characteristic is determined by Null-space based sound field control.

15. The sound reproduction system of claim 4, wherein the second control characteristic is determined by Null-space based sound field control.

16. The sound reproduction system of claim 3, wherein the first control characteristic is determined by a weighted least squares method.

17. The sound reproduction system of claim 4, wherein the first control characteristic is determined by a weighted least squares method.

18. The sound reproduction system of claim 5, wherein the first control characteristic is determined by a weighted least squares method.

19. The sound reproduction system of claim 2, wherein a characteristic changing unit is configured to change a frequency characteristic of a given sound, the sound reproduction system allows the characteristic changing unit to change a frequency characteristic of the second sound adaptively to an ambient sound.

20. The sound reproduction system of claim 8, wherein the characteristic changing unit changes a frequency of the second sound as the frequency characteristic of the second sound.

* * * * *